US005635943A

United States Patent [19]

Grunwell

[11] Patent Number: 5,635,943

[45] Date of Patent: Jun. 3, 1997

[54] TRANSCEIVER HAVING RETRACTABLE ANTENNA ASSEMBLY

[75] Inventor: Randall L. Grunwell, Suwanee, Ga.

[73] Assignee: Matsushita Communication Industrial Corp. of America, Peachtree City, Ga.

[21] Appl. No.: 543,363

[22] Filed: Oct. 16, 1995

[51] Int. Cl.[6] ..... H01Q 1/24

[52] U.S. Cl. ..... 343/702; 343/729; 343/862; 343/900

[58] Field of Search ..... 343/900, 702, 343/901, 724, 729, 862; 455/89, 90; H01Q 1/24

[56] References Cited

U.S. PATENT DOCUMENTS

| | | | |
|---|---|---|---|
| 4,847,629 | 7/1989 | Shimazaki | 343/901 |
| 4,860,024 | 8/1989 | Egashira | 343/702 |
| 4,862,182 | 8/1989 | Egashira | 343/702 |
| 4,890,114 | 12/1989 | Egashira | 343/702 |
| 5,030,966 | 7/1991 | Chin et al. | 343/702 |
| 5,136,302 | 8/1992 | Chin et al. | 343/702 |
| 5,144,324 | 9/1992 | Chin et al. | 343/702 |
| 5,177,492 | 1/1993 | Tomura et al. | 343/702 |
| 5,204,687 | 4/1993 | Elliott et al. | 343/702 |
| 5,212,491 | 5/1993 | Chin et al. | 343/745 |
| 5,245,350 | 9/1993 | Sroka | 343/702 |
| 5,302,963 | 4/1994 | Wiggenhorn | 343/901 |
| 5,317,325 | 5/1994 | Bottomley | 343/702 |
| 5,353,036 | 10/1994 | Baldry | 343/702 |
| 5,374,937 | 12/1994 | Tsunekawa et al. | 343/702 |
| 5,455,595 | 10/1995 | Yokoyama et al. | 343/702 |
| 5,521,605 | 5/1996 | Koike | 343/702 |

*Primary Examiner*—Michael C. Wimer
*Attorney, Agent, or Firm*—Jones & Askew

[57] ABSTRACT

A transceiver (10) having a retractable antenna (12) that substantially reduces interference when the antenna is in a retracted position. The transceiver (10) includes transceiver circuitry (T), operating at a predetermined frequency, electrically connected to the retractable antenna (12). The retractable antenna (12) includes two antenna elements (20, 22). A first antenna element (20) comprises a whip antenna element, movable within a conductive tube (14) housed within a cellular telephone case (C). A second antenna element (22) comprises a helical coil antenna element extending from the whip antenna element (20) and located outside the case (C). In the retracted position, a first contact assembly (76) contacts the whip antenna element (20). The first contact assembly (76) is electrically connected to the transceiver circuitry (T) through a conductor (96) which is a predetermined multiple of a quarter wavelength at the predetermined frequency. In the retracted position the whip antenna element (20) and the conductive tube (14) form a coaxial transmission line so that only the helical coil antenna element (22) is electrically active and the whip antenna element (20) does not radiate internal to the case (C). In the extended position, a second contact assembly (74) contacts the whip antenna element (20) such that the whip antenna element (20) and the helical coil antenna element (22) are both electrically active. In the extended position, the lower conductor (86), the conductive tube (14) and the first contact assembly (76) act as a predetermined multiple of a one-quarter wavelength stub and appear as an open circuit to the transceiver circuitry.

14 Claims, 3 Drawing Sheets

TRANSCEIVER HAVING RETRACTABLE ANTENNA ASSEMBLY

TECHNICAL FIELD

This invention relates to an improvement in transceivers and more particularly, to a retractable antenna for use with a cellular radio transceiver that substantially reduces internal RF interference.

BACKGROUND OF THE INVENTION

The growth in the use of transceiving devices, such as portable cellular telephones, is a testament to the devices' convenience, availability and value. The quality and the availability of cellular telecommunication services have dramatically influenced the public's acceptance of this technology. The growth of the cellular industry has been significantly accelerated due to many improvements in the transmitting and receiving of signals.

In earlier days of cellular technology, a typical cellular transceiver comprised a handset hardwired to a base unit. An example of such a transceiver is a unit that included a handset and a base, all of which was to be carried in a tote bag. The handset included a dialing keypad and circuitry for providing convenience features such as automatic dialing memory. The base housed the transceiver circuitry and a battery. An external antenna, oftentimes fixed, was connected to the base unit.

In time, the technology evolved until, today, cellular transceivers are known that are pocket-sized and hand-held. These modern cellular transceivers provide the traditional equipment described above, but the transceiver circuitry, battery and antenna are contained in a single unit or case.

Various types of antennas are known for use with modern cellular transceivers. One such is a fixed rod antenna. Rod antennas have traditionally been affixed rigidly to the transceiver case and, consequently, extend from the case at all times. This type of antenna provides good transmission and reception, but is not convenient for users. Such transceivers are difficult if not impossible to carry in a shirt or coat pocket. The user oftentimes finds the device to be unwieldy due to the protruding rod antenna.

Alternatively, retractable rod antennas have been used and are known in the art. A retractable rod antenna is preferred for convenience reasons, as the antenna may be readily withdrawn and substantially contained within the transceiver case. This is much more convenient for the user. When a retractable rod antenna is provided, some portion of the antenna must yet be active, even when the antenna is fully retracted, so as to allow the transceiver to receive a call signal while in the "stand-by" or "receive only" mode of operation. Compound antennas have been proposed to address this concern. Compound antennas provide a primary antenna element that can be retracted into the transceiver case and a secondary antenna element that remains outside the transceiver case to facilitate operation in the stand-by mode. The secondary antenna element is conventionally attached to the primary antenna element. The secondary antenna element remains active for receipt of an incoming call signal. An example of such a retractable, compound antenna is shown in U.S. Pat. No. 5,204,687, issued to Elliott et al.

Further, it is desirable to be able to conduct some communication, even if only over a limited range, without having to extend the antenna. Therefore, it is preferred that the secondary antenna element should also be useful for transmitting. However, the retracted primary antenna element will also radiate when the transceiver is transmitting. This radiation may be coupled back into the transceiver circuitry and interfere with proper operation thereof. To reduce this problem, some antenna assemblies have employed switching arrangements that, upon retraction of the primary antenna element into the transceiver case, de-couple the retracted primary antenna element from the transceiver circuitry and then couple the secondary antenna element to the transceiver circuitry. This type of switching arrangement is shown in the Elliott et al. patent.

Alternatively, other assemblies shield the antenna within the transceiver case to prevent radiation emitted by the retracted primary antenna element from causing interference with the transceiver circuitry.

Another alternative antenna assembly includes a retracted antenna and a separate internal antenna, for stand-by operation, enclosed within the cellular transceiver case. Such an antenna arrangement is shown in U.S. Pat. No. 4,862,182 to Egashira. This alternative antenna assembly requires expensive and relatively bulky switching devices to de-couple the retracted primary antenna and couple the internal antenna. The extra space required for the separate internal antenna and the weight of the internal antenna increases the overall size and weight of cellular transceivers employing this type of antenna assembly.

Thus, many prior art antenna arrangements have placed significant restrictions on the design, cost and use of hand-held cellular transceivers. Shielding and switching devices necessary to allow extendible antennas, complemented by either a compound antenna or an internal antenna, have added cost and weight to these hand-held cellular transceivers. Such additions have made the use and operation of these transceivers less convenient. Further efforts to reduce the cost, weight and size have been stalled because of the limitations of these current antenna designs.

What is needed and what is not available is a retractable antenna for use with a hand-held cellular transceiver that is small, light in weight and relatively inexpensive. The needed retractable antenna must provide satisfactory operation in both the retracted and extended positions so that satisfactory transmission and reception may be achieved and not degrade the performance of the radio by internal electromagnetic radiation emitted from the retracted portion of the antenna.

SUMMARY OF THE INVENTION

The present invention solves the above described problems in the art by providing a retractable antenna assembly for a cellular transceiver. The present invention provides satisfactory transmission and reception, even when the antenna is retracted, and further reduces interference with the signal as a result of radiation emitted from the retracted portion of the antenna.

Generally described, the present invention comprises a retractable antenna for use with a radio circuit operating over a band of desired frequencies. Described more particularly, the retractable antenna comprises a conductive tube having a first end and a second end, a first electrical contact located at the first end of the conductive tube and electrically isloated from the conductive tube, a second electrical contact located at the second end of the conductive tube and electrically isotated from the conductive tube, a first antenna element disposed within the conductive tube between the first electrical contact and the second electrical contact, a second antenna element in operative connection with the first antenna element and disposed to the exterior of the conductive tube, and a conductor for connecting the first electrical contact to the second electrical contact, wherein the conductor is a predetermined multiple of a quarter wavelength of the radio circuit operating frequency and is external to the conductive tube.

A preferred embodiment of the present invention includes a conductive tube having a first end and a second end, and within which an antenna is received. The antenna includes a first antenna element and a second antenna element. The first antenna element may be carried within the conductive tube. The first antenna element is adapted to move within the conductive tube between a retracted position and an extended position. A second antenna element extends from and is electrically connected to the first antenna element. The second antenna element resides substantially outside of the conductive tube regardless of the position of the first antenna element within the conductive tube. The first antenna element selectively engages first and second electrical contacts located adjacent the first and second ends of the conductive tube. The first antenna element is electrically connected to the transceiver circuitry only when the first antenna element is placed in either the retracted position or the extended position.

When the first antenna element of the present invention is in the retracted position, the first antenna element electrically contacts the second antenna electrical contact. The first antenna element and the conductive tube form a self-shielding or field-contained structure, such as a coaxial transmission line. This coaxial transmission line is connected, via the second antenna electrical contact, between the second antenna element and the radio circuitry. Therefore, the first antenna element is not active for transmitting or receiving and only the second antenna element is electrically active for transmitting and receiving.

When the first antenna element is in the extended position, the first antenna element electrically contacts the first antenna electrical contact so that both the first and second antenna elements are active for transmitting and receiving.

The present invention provides a retractable antenna for use with a radio circuit operating over a band of desired frequencies. The retractable antenna has a conductive tube having a first end and a second end, a first electrical contact located at the first end of the conductive tube and electrically isolated from the conductive tube, a second electrical contact located at the second end of the conductive tube and electrically isolated from the conductive tube, a first antenna element having a junction at a first end and an electrical contact at a second end, a second antenna element being connected to the junction at the first end of the first antenna element, a conductor for connecting the first electrical contact to the second electrical contact, and means for connecting the first electrical contact and the conductor to the radio circuitry. The first antenna element is preferably disposed within the conductive tube when in a retracted position. The electrical contact of the first antenna element is in contact with the first electrical contact when the first antenna element is in the retracted position, and the electrical contact of the first antenna element is in contact with the second electrical contact when the first antenna element is in an extended position. The second antenna element is substantially outside of the conductive tube both when the first antenna element is in the retracted position and when the first antenna element is in the extended position. The conductor is a predetermined multiple of a quarter wavelength at the desired frequency and is external to the conductive tube.

The present invention also provides a portable radio transceiver. The portable radio transceiver has a radio transceiver circuitry operating over a band of desired frequencies, a conductive tube having a first end and a second end, a first electrical contact located at the first end of the conductive tube and electrically isloated from the conductive tube, a second electrical contact located at the second end of the conductive tube and electrically isolated from the conductive tube, a first antenna element having a junction at a first end and an electrical contact at a second end, a second antenna element being connected to the junction at the first end of the first antenna element, a conductor for connecting the first electrical contact to the second electrical contact, and means for connecting the first electrical contact and the conductor to the radio circuit. The first antenna element is preferably disposed within the conductive tube when in a retracted position. The electrical contact of the first antenna element is in contact with the first electrical contact when the first antenna element is in the retracted position, and the electrical contact of the first antenna element is in contact with the second electrical contact when the first antenna element is in an extended position. The second antenna element is substantially outside of the conductive tube both when the first antenna element is in the retracted position and when the first antenna element is in the extended position. The conductor is a predetermined multiple of a quarter wavelength at a selected frequency in the band of desired frequencies and is external to the conductive tube.

Thus, the present invention provides a transceiver which has a retractable antenna of a novel design. The retractable antenna has a conductive tube, a rod antenna, a loading coil which functions as an antenna, an upper and a lower contact assembly, and a lower conductor, which may function as an impedance-transforming conductor. When the antenna is extended, the transceiver is connected to the rod and the loading coil, which then function as a single antenna, through the upper contact, and the lower conductor makes the lower contact appear as an open circuit to the transceiver. When the antenna is retracted, the rod and the conductive tube function as a coaxial transmission line feeding the loading coil. The upper conductor is sufficiently short to appear as an open circuit when the antenna is retracted.

Thus, it is an object of the present invention to provide a transceiver with an improved retractable antenna.

It is a further object of the present invention to provide a retractable antenna for a cellular transceiver.

It is a further object of the present invention to provide a retractable antenna for a hand-held cellular transceiver.

It is another object of the present invention to provide a retractable antenna for a cellular transceiver that reduces interference due to internal radiation from the retractable portion of the antenna when the antenna is retracted.

It is a further object of the present invention to provide a retractable antenna assembly that substantially and efficiently reduces interference due to internal radiation from the retractable portion of the antenna even when transmitting with the antenna in a retracted position.

It is another object of the present invention to provide a retractable antenna for a cellular transceiver capable of receiving a call signal when the antenna is retracted.

It is another object of the present invention to provide a portable cellular transceiver that is light in weight and small in size to make its use easier and more convenient without compromising the quality of telecommunication.

It is another object of the present invention to provide a portable cellular transceiver having a retractable antenna that reduces interference due to internal radiation from the retracted portion of the retractable antenna.

Other objects, advantages and features of the present invention will be more readily understood from the following detailed description of specific embodiments thereof when read in conjunction with the accompanying drawings.

DETAILED DESCRIPTION

Figures 1A, 1B:
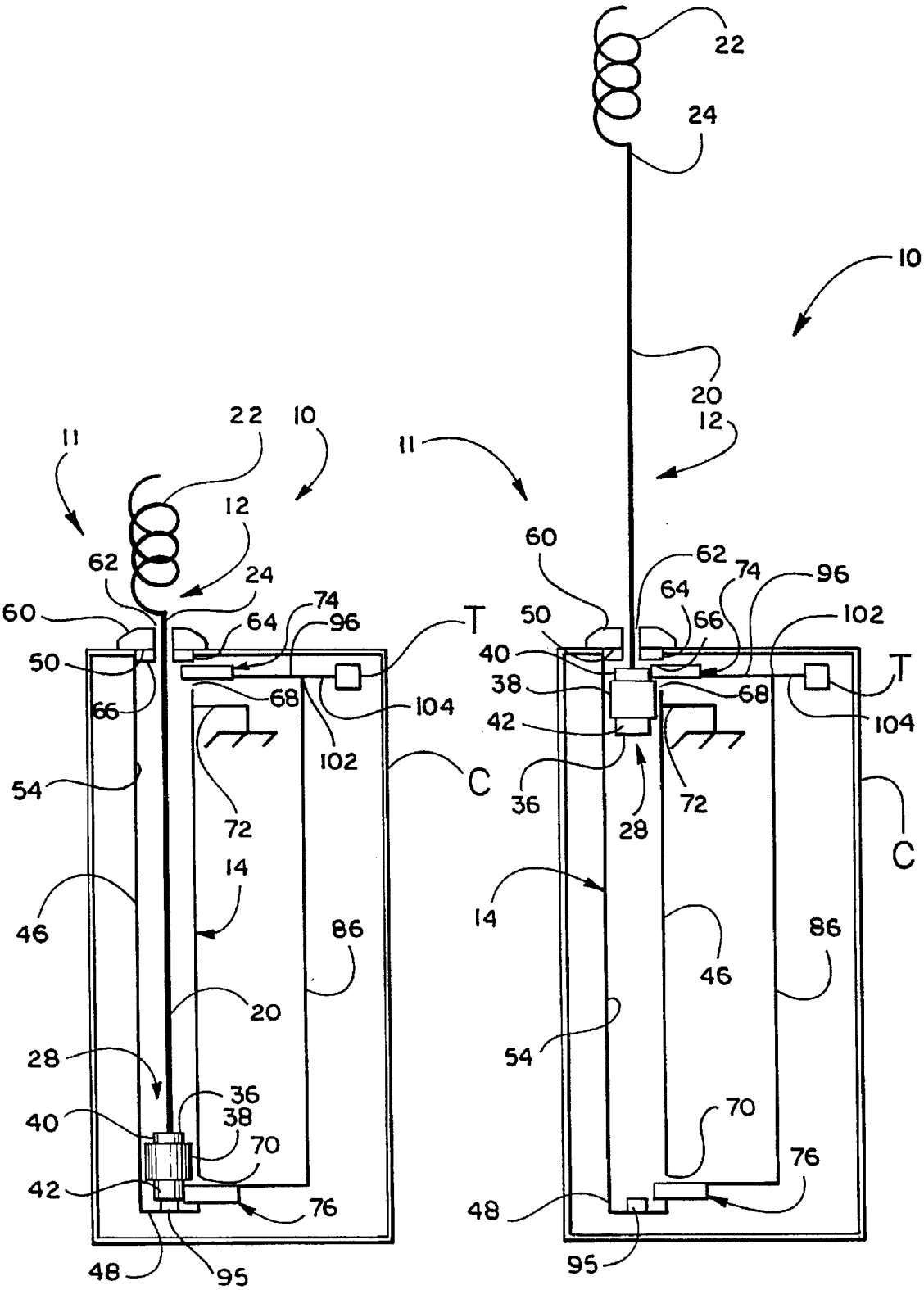
FIG. 1A is a schematic view of a transceiver in accordance with the present invention having a retractable antenna assembly shown in a retracted configuration.
FIG. 1B is a schematic view of a transceiver in accordance with the present invention having a retractable antenna assembly, shown in FIG. 1A, in an extended configuration.

Referring now in more detail to the drawings, in which like numerals refer to like parts throughout the several views, FIGS. 1A and 1B depict a radio transceiver device 10 in accordance with the present invention. The radio transceiver device 10 includes a case C, which houses a retractable antenna assembly 11 electrically connected to transceiver circuitry T. Those having ordinary skill in the art will understand that the transceiver circuitry T may comprise radio frequency circuitry, power supply circuitry and other circuitry for providing dialing and special feature capabilities. The specifics of the transceiver circuitry T are well-known in the art and need not be disclosed in detail herein.

The retractable antenna assembly 11 includes an antenna 12, a conductive tube 14, an upper finger contact assembly 74, a lower finger contact assembly 76, a lower conductor 86 and an upper conductor 96. The lower conductor 86 and the upper conductor 96 are external to the conductive tube 14. The conductive tube 14 is maintained at ground potential with respect to the transceiver circuitry T through a ground strap or conductor 72 in a conventional manner. If lower conductor 86, upper conductor 96, or the conductor 104 between junction 102 and the transceiver T is a coaxial cable then ground strap 72 may be implemented by the shield of such a coaxial cable. Junction 102 and conductor 104 form a means for connecting the conductors 86 and 96, and therefore the upper and lower finger contact assemblies 74 and 76, to the transceiver circuitry T.

Figure 1C:
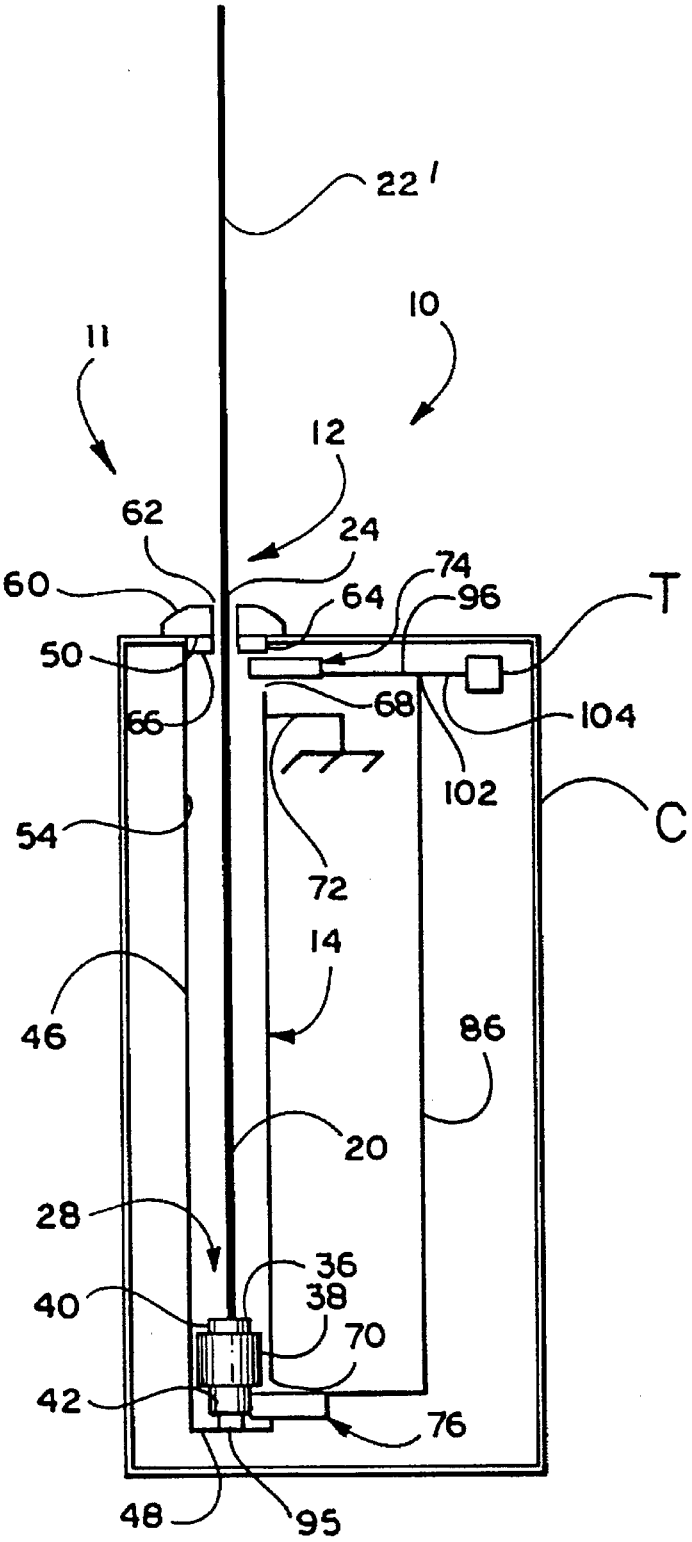
FIG. 1C is a schematic view of an alternative embodiment of the present invention having a rigid, second whp antenna element.

The antenna 12 is shown in a retracted position in FIG. 1 and in an extended position in FIG. 2. The antenna 12 is a compound antenna which comprises two radiating elements: a first antenna element embodied as an elongate, rigid whip antenna element 20, and a second o antenna element embodied as a helical coil antenna element 22. The helical coil antenna element 22 is attached to the whip antenna element 20 at a junction 24. In an alternative embodiment of the retractable antenna of the present invention, the second antenna element may be embodied as a rigid second whip antenna element 22', shown in FIG. 1 C, instead of the helical coil antenna element 22.

The whip antenna element 20 is fabricated to provide a predetermined equivalent electrical length which is appropriate for the operating frequency and wavelength of the transceiver circuitry T. For example, if the operating frequency of the transceiver circuitry is 900 MHz, then the signal wavelength is 33.3 centimeters (cm). Thus, if the whip antenna element 20 is a ¼ wavelength antenna then the length of the whip antenna element 20 would be approximately 8.3 cm. A different length antenna, whether shorter or longer, may also be used provided that the antenna element 20, together with the helical coil antenna element 22, are impedance matched by using discrete elements or impedance matching devices. It should be noted that the combined electrical length of the antenna element 20 and the helical coil antenna element 22 may be chosen such that the antenna is matched.

The helical coil antenna element 22 extends from and is connected to the junction 24 and is formed in a helical shape with spaced apart coils. The helical coil antenna element 22 remains outside the conductive tube 14 and the case C at any extended position of the antenna 12. Also, the helical coil antenna element 22 is substantially outside of, and preferably completely outside of, the conductive tube 14 when the antenna 12 is in the fully retracted position. Because it is always at least substantially outside of the conductive tube 14, the helical coil antenna element 22 is always poised to transmit or receive radio signals with minimal interference with the transceiver circuitry T. The helical coil antenna element 22, by itself, provides a sufficient antenna for short range communications so that the cellular transceiver device 10 can receive and transmit when the antenna 12 is retracted.

Figure 2A:
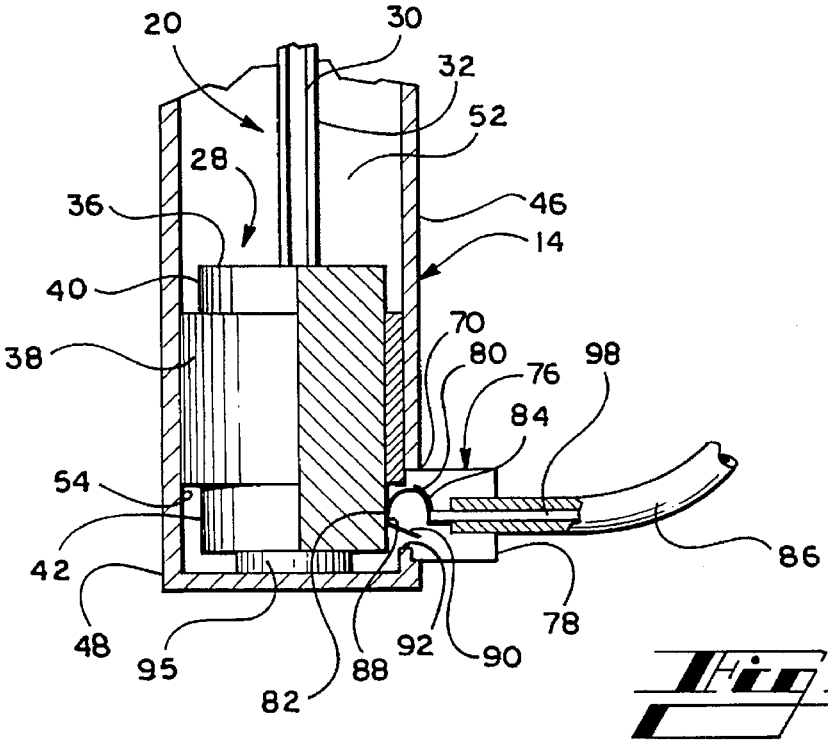
FIG. 2A is a side view, shown in partial cross section, of the lower finger contact assembly of the present invention when the antenna is in a fully retracted position.
Figure 2B:
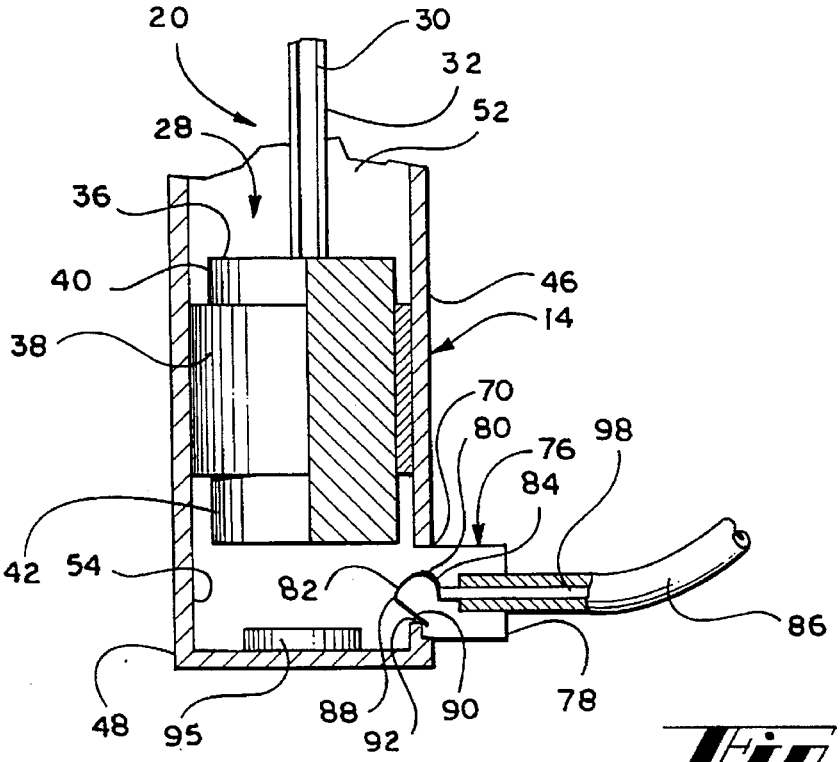
FIG. 2B is a side view, shown in partial cross-section, of the lower finger contact assembly of the present invention when the antenna is in a non-fully retracted position.

Referring briefly to FIGS. 2A and 2B, it will be seen that the whip antenna element 20 has a central conductive core 30 and is surrounded by a protective sheath 32. The central conductive core 30 may be a rigid rod or a wound wire semi-rigid coil. A wound wire semi-rigid coil may consist of a hard drawn conductive wire, beryllium copper for example, wound in a tight helical pattern, usually without spacing between adjacent helical coils. A wound wire semi-rigid coil thus resembles a small diameter tension spring. The wound wire construction enhances the flexibility of the whip antenna element 20 to help prevent antenna breakage when the whip antenna element 20 is extended from the case C and is deflected side-to-side during use.

With either the rigid rod or wound wire construction, the protective sheath 32 is disposed about the central conductive core 30. The protective sheath 32 may be a plastic film applied to the central conductive core 30 by extrusion for example. Alternatively, the outer protective sheath 32 may be a plastic tube slipped over the central conductive core 30. The protective sheath 32 protects the central conductive core 30 from wear and electrical shorting against an external body, either of which may degrade the radiation characteristics of the whip antenna element 20.

The whip antenna element 20 is operatively connected to a contact and guide assembly 28, which includes a conductive sleeve 36 which is mounted to the end of the whip antenna element 20 opposite the junction 24. An insulating sleeve 38 is mounted about and covers a central portion of the conductive sleeve 36. As a result, one portion of the conductive sleeve 36 forms an upper contact surface 40 and another portion of the conductive sleeve 36 forms a lower contact surface 42, at opposed ends of the conductive sleeve 36.

The conductive tube 14 comprises an elongate tubular body 46 having a closed end 48 and an opposed open end 50 as shown in FIGS. 1A and 1B. The tubular body 46 defines a conductive tube bore 52 and an inner surface 54. The tubular body 46 is preferably fabricated of a conductive material, such as copper. However, the tubular body 46 may be fabricated from other materials, including non-conductive materials, such as plastic, by coating or plating the interior of the tubular body 46 with a conductive material so as to be electrically equivalent to a conductive tubular body 46. The diameter of the tubular body 46 is sized to create a 50 Ω (ohm) coaxial transmission line with the whip antenna element 20 when the whip antenna element 20 is retracted fully within the conductive tube bore 52. It will be appreciated that 50 ohms is a design choice and that other impedance values may be used. The impedance value selected should be based upon the impedance of the helical coil antenna element 22 functioning as the antenna 12.

In the preferred embodiment the outside diameter of the insulating sleeve 38 is selected to allow the whip antenna element 20 to freely slide within the conductive tube 14. The whip antenna element 20 is held in the retracted position by the pressure exerted against the contact and guide assembly 28 by the contact strip 80 of lower finger contact assembly 76. Inasmuch as the finger contact assemblies 74 and 76 are substantially identical in structure and function, only the lower finger contact assembly 76 will be explained in detail below. The whip antenna element 20 is held in the extended position by the pressure exerted against the contact and guide assembly 28 by a similar contact strip (not shown) of upper finger contact assembly 76. A detent action may also be used with contact assemblies 74 and 76 if desired.

In an alternative embodiment the outside diameter of the insulating sleeve 38 is selected to coaxially support the whip antenna element 20 within the conductive tube 14 with an interfering sliding fit with the inner surface 54. The interference between the insulating sleeve 38 and the inner surface 54 allows the antenna 12 to be firmly yet adjustably supported as desired without excessive effort required to retract or extend the antenna 12.

FIGS. 1A and 1B further show an antenna guide bushing 60 mounted within an opening in the case C adjacent an open end 50 of the conductive tube 14. The antenna guide bushing 60 defines a central aperture 62 through which whip antenna element 20 extends. As the whip antenna element 20 is moved from its retracted position to its extended position and back, the antenna guide bushing 60 cooperates with the insulating sleeve 38 to maintain whip antenna element 20 coaxially disposed within the conductive tube 14. A stub 64 of the antenna guide bushing 60 defines a reduced diameter protrusion that may be received into the conductive tube 14 to secure the antenna guide bushing 60 and coaxially align the central aperture 62 with the conductive tube 14. The lower portion of the stub 64 defines an abutment surface 66 transverse to the axis of the central aperture 62. As the antenna 12 is extended the conductive sleeve 36 engages the abutment surface 66 and thereby defines and limits the maximum extension of the whip antenna element 20 from within the conductive tube 14. In another embodiment the insulating sleeve 38, and not the conductive sleeve 36, defines and limits the maximum extension of the whip antenna element 20.

The elongate tubular body 46 has upper and lower contact openings, 68 and 70, adjacent the open end 50 and the closed end 48, respectively, of the elongate tubular body 46. The contact openings 68 and 70 provide access for electrical contacts of the upper and lower finger contact assemblies 74 and 76, respectively.

The lower finger contact assembly 76 is shown in more detail in FIGS. 2A and 2B. The lower finger contact assembly 76 includes a contact block 78 which is secured to and overlays the lower contact opening 70. The contact block 78 supports an electrical contact, preferably embodied as a generally "C" shaped contact strip 80 adjacent the lower contact opening 70. The contact strip 80 is fabricated of a hard drawn conductive metal, such as phosphor bronze or beryllium copper, because these copper based metal alloys exhibit resistance to fatigue failure due to flexure. The contact strip 80 may be plated with silver or gold to enhance the integrity of the its contact with the conductive sleeve 36.

The contact strip 80 defines an end portion 84, a central arcuate portion 82, and a free end 88. End portion 84 is rigidly engaged with the contact block 78. The center conductor 98 of lower conductor 86 is electrically connected to the end portion 84 of the contact strip 80, thereby electrically connecting the contact strip 80 to the transceiver circuitry T. The central arcuate portion 82 protrudes through the lower contact opening 70 and extends into the conductive tube bore 52. The positioning of the central arcuate portion 82 within the conductive tube bore 52 of the elongate tubular body 46 will cause the central arcuate portion 82 to interfere with the travel of the whip antenna 12. The free end 88 of the contact strip 80 is unrestrained and may be deflected by the engagement of the lower contact surface 42 with the contact strip 80 when the antenna 12 is retracted. In a preferred embodiment of the present invention, the free end 88 of the contact strip 80 does not electrically contact the conductive tube 14.

The travel of the antenna 12 along the conductive tube 14 is father limited by an insulating bumper 95 secured to the closed end 48 of the tube. The insulating bumper 95 prevents the whip antenna element 20 and the lower contact surface 42 from shorting to the conductive tube 14 and ensures proper registration of the lower contact surface 42 with the contact strip 80. The insulating bumper 95 also absorbs some of the shock when the antenna 12 is thrust into the retracted position with excessive force. In another embodiment the insulating bumper 95 is affixed to the lower end of conductive sleeve 36.

Referring again to FIGS. 1A and 1B, the preferred embodiment also includes an upper finger contact assembly 74, which is constructed in the same manner as the lower finger contact assembly 76. The upper finger contact assembly also has an electrical contact, also preferably embodied as a contact strip, which contacts the upper contact surface 40 when the antenna 12 is in the extended position. The conductors 86 and 96 are connected together at junction 102. The junction 102 may be part of the transceiver circuitry T, such as the output port, or may be connected to the transceiver T via a conductor 104. Thus, in the retracted position of the antenna 12, the transceiver circuitry T is connected to the antenna 12 through lower conductor 86 and lower finger contact assembly 76. In the extended position of the antenna 12, the transceiver circuitry T is connected to the antenna 12 through upper conductor 96 and upper finger contact assembly 74. The conductors 86, 96 and 104 are preferably shielded, insulated conductors, such as coaxial cables, rated for operation at the frequencies of interest.

Electrical contact between the transceiver circuitry T and the antenna 12 is established only when the antenna 12 is fully retracted or fully extended. Thus, there is no electrical contact between the antenna 12 and the transceiver circuitry T at intermediate points of antenna extension or retraction.

When the antenna 12 is retracted, as shown in FIG. 1, the lower contact surface 42 of the conductive sleeve 36 is in electrical contact with the contact strip 80 (FIGS. 2A and 2B) of the lower finger contact assembly 76, and there is no electrical contact between the antenna 12 and the upper finger contact assembly 74. The conductive tube 14 cooperates with the coaxially located whip antenna element 20 to provide a 50 Ω transmission line between the helical coil antenna element 22 and the lower conductor 86. The conductive tube 14 and the whip antenna element 20 act together as a transmission line such that the whip antenna element 20 does not radiate and there is no interference with the transceiver circuitry T. Thus, in the retracted antenna position, the helical coil antenna element 22 is the only portion of the antenna 12 that is electrically active.

As the antenna 12 is extended, the lower contact surface 42 of the conductive sleeve 36 disengages from contact strip 80 of the lower finger contact assembly 76. The antenna 12 is extended until the conductive sleeve 36 engages the abutment surface 66 of the antenna guide bushing 60. At that point, upper contact surface 40 of the conductive sleeve 36 electrically engages the contact strip (not shown separately) of the upper finger contact assembly 74. The whip antenna element 20 and the helical coil antenna element 22 then function as a single antenna when the antenna 12 is in the extended position. This increases the efficiency, for both transmitting and receiving, of the antenna 12.

Although the first antenna element, whip antenna element 20, is preferably at least partially disposed within the conductive tube 14 in both the extended and the retracted positions, in another embodiment the antenna guide bushing 60 may be affixed to the case C, or part of the case C, such that there is a gap between the end of the conductive tube 14 and the antenna guide bushing 60. As a consequence, the first antenna element may be extended so that it is completely outside the conductive tube 14. This configuration is acceptable as long as, in the extended operating position, the first antenna element is still electrically connected to the transceiver T via the upper finger contact assembly 74. For ease of use, a portion of the contact and guide assembly 28 should remain within the conductive tube 14 or means should be provided to guide the assembly 28 into the conductive tube 14 if the assembly 28 has been extended outside of the conductive tube 14.

In the preferred embodiment, the upper conductor 96 is a negligible portion of a wavelength, such as less than one-tenth of a wavelength, the lower conductor 86 has an equivalent electrical length of one-half wavelength, and neither the upper finger contact strip in assembly 74 nor the lower finger contact strip 80 in assembly 76 short to the conductive tube 14 at any time. Thus, when the antenna 12 is in the extended position, the lower conductor 86 and contact strip 80 act as an open, one-half wavelength stub and appear as an open circuit to the transceiver circuitry T. Therefore, the transceiver circuitry T appears to be connected only to the compound antenna 12 through the upper conductor 96. Then, when the antenna 12 is in the retracted position, the upper conductor 96 and the upper finger contact assembly 74 appear as an open circuit, and the lower conductor 86 and the whip antenna element 20, in cooperation with the conductive tube 14, act as a transmission line connected to the helical coil antenna element 22. Thus, the transceiver circuitry T only sees a transmission line connected to the helical coil antenna element 22.

Thus, the length of the lower conductor 86 is functional with regard to the electrical characteristics of the antenna assembly 11. Advantageously, however, only the electrical length of the lower conductor 86 is important, and not the configuration or lay of the lower conductor 86 used to achieve that electrical length. Therefore, the lower conductor 86 may be disposed within the case C without particular concern for its configuration as long as the proper electrical length is achieved. This feature avoids design limitations of the cellular transceiver case C size while still providing the necessary electrical function.

In another embodiment, the lower conductor 86 has an equivalent electrical length of a multiple of one-half wavelength (an even multiple of a one-quarter wavelength).

In another embodiment, the junction 102 is at the upper finger contact assembly 74 and there is no separate upper conductor 96.

In another embodiment of the present invention the lower conductor 86 is an odd multiple of one-quarter wavelength and the contact strip 80 shorts to the conductive tube 14 when the antenna 12 is extended. The lower conductor 86 thus acts an impedance-transforming conductor so that the short between contact strip 80 and conductive tube 14 appears as an open circuit at the transceiver circuitry T. To accomplish this, the free end 88 of the contact strip 80 is extended to form a contact tang 90 (FIGS. 2A and 2B). The contact tang 90 is effective to short the center conductor 98 of lower conductor 86 to the conductive tube 14 when the antenna 12 is moved to the extended position. As shown in FIG. 2B, the contact tang 90 is adapted to engage a lower edge 92 of the lower contact opening 70 when the antenna 12 is not fully retracted. As the antenna 12 is further retracted into the conductive tube 14, the lower contact surface 42 engages the central arcuate portion 82 of the contact strip 80 causing the central arcuate portion 82 and the contact tang 90 to deflect. At the fully retracted position of the antenna 12, electrical contact between the lower edge 92 and the contact tang 90 is opened and the antenna 12 is placed, simultaneously, into electrical contact with the transceiver circuitry T.

It will be appreciated that lumped circuit elements (not shown) may be used in addition to, or in place of, the lower conductor 86. The lumped circuit elements simulate a conductor 86 having the desired electrical length.

If the transceiver T only operates at a single frequency or over a very narrow band of frequencies then the determination of the length of the whip antenna element 20 and the lower conductor 86 is straightforward. However, if the transceiver T operates over a non-narrow band of frequencies then the lengths determined for operation at one end of the band of frequencies may be inappropriate for operation at the other end of the band. Therefore, the lengths are chosen for a desired point, such as near the center of the band, or at the frequency where the best operation is desired. The lengths at other frequencies will not be optimum and, as a consequence, performance at the ends of the band of operation may not be as advantageous as performance at the selected frequency.

Thus, the present invention provides a transceiver T which has a retractable antenna assembly 11 of a novel design. The retractable antenna assembly 11 has a conductive tube 14, a rod antenna, such as a whip antenna element 20, a helical coil antenna element 22, which may function both as an antenna and as a loading coil, an upper 74 and a lower 76 finger contact assembly, and a lower conductor 86, which may function as an impedance-transforming conductor. When the antenna 12 is extended, the transceiver circuitry T is connected to the whip antenna element 20 and the helical coil antenna element 22, which then function in series as a single antenna, through the upper finger contact assembly 74, and the lower conductor 86 and the lower finger contact assembly 76 appear as an open circuit to the transceiver circuitry T. In this position, the helical coil antenna element 22 may serve as a loading coil as well as an antenna element. When the antenna 12 is retracted, the whip antenna element 20 and the conductive tube 14 function as a coaxial transmission line feeding the helical coil antenna element 22, which then functions primarily as an antenna. The upper conductor 96 is sufficiently short to appear as an open circuit when the antenna 12 is retracted.

Although the preferred embodiment of the conductive tube 14 has been described with a circular cross section it will be appreciated that the conductive tube 14 may have other geometries, such as square, triangular, hexagonal, oval, etc. Different geometries may provide different advantages in manufacturing, stability, cost, aesthetics, etc. Likewise, the whip antenna element 20, the contact and guide assembly 28, etc., preferably have circular cross sections but may also be implemented with different geometries. A different geometry may result in a structure which has a different technical name, such as a stripline with an air dielectric. However, these different geometries all provide the same result: a self-shielding or field-contained structure. Therefore, the present invention is not limited to a particular geometry, and the terms "tube" and "rod" should be understood as not being limited to a design having circular cross-section. In addition, although the conductive tube 14 and the whip antenna element 20 are shown as being straight, the present invention is not so limited. For example, using curved components for the conductive tube 14 and the whip antenna element 20 would allow the length of the whip antenna element 20 to be increased, given a fixed size enclosure, or allow the desired length of the whip antenna element 20 to be attained while using a smaller size enclosure.

Although the preferred embodiment of the present invention has been described with lower conductor 86 having a length equivalent to a multiple of a one-quarter wavelength and upper conductor 96 having negligible length, in an alternative embodiment the opposite is true. That is, lower conductor 86 has negligible length, and upper conductor 96 has a length equivalent to a multiple of a one-quarter wavelength. In this case, junction 102 is close to, or at, lower finger contact assembly 76. Still, in the extended position of the antenna the lower finger contact assembly 76 is open and the transceiver circuitry T is connected to the antenna through the upper conductor 96 and the upper finger contact assembly 74, and in the retracted position of the antenna the transceiver circuitry T is connected to the antenna through the lower conductor 86 and the lower finger contact assembly 76. However, in the retracted position, the upper conductor 96 and the upper finger contact assembly 74 appear as an open circuit to the transceiver circuitry T. When the antenna is in the retracted position the upper finger contact assembly 74 may be an open circuit if the upper conductor 96 is an even multiple of a one-quarter wavelength (a multiple of a half-wavelength), or the upper finger contact assembly 74 may be shorted to the conductive tube 14 if the upper conductor 96 is an odd multiple of a one-quarter wavelength.

Although the term "multiple" generally means an integer greater than one that term, as used herein, includes the first multiple, that is, one. Therefore, the term multiple should be understood as being any non-zero, positive integer.

While the present invention in its various aspects has been described in detail with regard to preferred embodiments thereof, it should be understood that variations, modifications and enhancements can be made to the disclosed apparatus and procedures without departing from the spirit and scope of the present invention as defined in the appended claims.

I claim:

1. A retractable antenna for use with a radio circuit operating at a desired frequency, comprising:

a conductive tube having a first end and a second end;

a first electrical contact located at said first end of said conductive tube and electrically isolated from said conductive tube;

a second electrical contact located at said second end of said conductive tube and electrically isolated from said conductive tube;

a first antenna element having a junction at a first end and an electrical contact at a second end, said first antenna element being at least partially disposed within said conductive tube when said first antenna element is in a retracted position, said electrical contact of said first antenna element being in contact with said first electrical contact when said first antenna element is in said retracted position, and said electrical contact of said first antenna element being in contact with said second electrical contact when said first antenna element is in an extended position;

a second antenna element being connected to said junction at said first end of said first antenna element, said second antenna element being substantially outside of said conductive tube;

a conductor for connecting said first electrical contact to said second electrical contact, said conductor having an electrical length approximately equal to a multiple of a quarter wavelength at said deisred frequency, said conductive being external to said conductive tube; and means for connecting said first electrical contact and said conductor to said radio circuit.

2. The antenna of claim 1 wherein said second antenna element is a coil antenna element.

3. The antenna of claim 1 wherein said second antenna element is a whip antenna element.

4. The antenna of claim 1 wherein, when said first antenna element is in said retracted position, said first antenna element and said conductive tube form a coaxial transmission line between said second antenna element and said first electrical contact.

5. The antenna of claim 1 wherein said conductor has an electrical length approximately equal to an even multiple of said quarter wavelength.

6. A retractable antenna for use with a radio circuit operating at a desired frequency, comprising:

a conductive tube having a first end and a second end;

a first electrical contact located at said first end of said conductive tube;

a second electrical contact located at said second end of said conductive tube;

a first antenna element having a junction at a first end and an electrical contact at a second end, said first antenna element being at least partially disposed within said conductive tube when said first antenna element is in a retracted position, said electrical contact of said first antenna element being in contact with said first electrical contact when said first antenna element is in said retracted position, and said electrical contact of said first antenna element being in contact with said second electrical contact when said first antenna element is in an extended position;

a second antenna element being connected to said junction at said first end of said first antenna element, said second antenna element being substantially outside of said conductive tube;

a conductor for connecting said first electrical contact to said second electrical contact, said conductor having an electrical length approximately equal to an odd multiple of a quarter wavelength at said desired frequency, and wherein said antenna further comprises grounding means for grounding said first electrical contact to said conductive tube when said first antenna is in said extended position; and means for connecting said first electrical contact and said conductor to said radio circuit.

7. The antenna of claim 6 wherein said grounding means comprises a contact tang operatively interconnected with said first electrical contact to cause said first electrical contact to be shorted to said conductive tube when said first antenna element is in said extended position and to cause said first electrical contact to be connected to said electrical contact of said first antenna element when said first antenna element is in a retracted position.

8. A portable radio transceiver, comprising:

a radio transceiver circuit operating at a desired frequency;

a conductive tube having a first end and a second end;

a first electrical contact located at said first end of said conductive tube and electrically isolated from said conductive tube;

a second electrical contact located at said second end of said conductive tube and electrically isolated from said conductive tube;

a first antenna element having a junction at a first end and an electrical contact at a second end, said first antenna element being at least partially disposed within said conductive tube when said first antenna element is in a retracted position, said electrical contact of said first antenna element being in contact with said first electrical contact when said first antenna element is in said retracted position, and said electrical contact of said first antenna element being in contact with said second electrical contact when said first antenna element is in an extended position;

a second antenna element being connected to said junction at said first end of said first antenna element, said second antenna element being substantially outside of said conductive tube;

a conductor for connecting said first electrical contact to said second electrical contact, said conductor having an electrical length equivalent to a multiple of a quarter wavelength at said desired frequency, said conductor being external to said conductive tube; and means for connecting said first electrical contact and said conductor to said radio transceiver circuit.

9. The portable radio transceiver of claim 8 wherein said second antenna element is a coil antenna element.

10. The portable radio transceiver of claim 8 wherein said second antenna element is a whip antenna element.

11. The portable radio transceiver of claim 8 wherein, when said first antenna element is in said retracted position, said first antenna element and said conductive tube form a coaxial transmission line between said second antenna element and said first electrical contact.

12. The portable radio transceiver of claim 8 wherein said conductor has an electrical length approximately equal to an even multiple of said quarter wavelength.

13. A portable radio transceiver, comprising:

a radio transceiver circuit operating at a desired frequency;

a conductive tube having a first end and a second end;

a first electrical contact located at said first end of said conductive tube;

a second electrical contact located at said second end of said conductive tube;

a first antenna element having a junction at a first end and an electrical contact at a second end, said first antenna element being at least partially disposed within said conductive tube when said first antenna element is in a retracted position, said electrical contact of said first antenna element being in contact with said first electrical contact when said first antenna element is in said retracted position, and said electrical contact of said first antenna element being in contact with said second electrical contact when said first antenna element is in an extended position;

a second antenna element being connected to said junction at said first end of said first antenna element, said second antenna element being substantially outside of said conductive tube;

a conductor for connecting said first electrical contact to said second electrical contact, said conductor having an electrical length approximately equal to an odd integer multiple of a quarter wavelength at said desired frequency, and wherein said antenna further comprises grounding means for grounding said first electrical contact to said conductive tube when said first antenna is in said extended position; and means for connecting said first electrical contact and said conductor to said radio transceiver circuit.

14. The portable radio transceiver of claim 13 wherein said grounding means comprises a contact tang operatively interconnected with said first electrical contact to cause said first electrical contact to be shorted to said conductive tube when said first antenna element is in said extended position and to cause said first electrical contact to be connected to said electrical contact of said first antenna element when said first antenna element is in a retracted position.

* * * * *